US009664018B2

(12) United States Patent
Vandeponseele et al.

(10) Patent No.: US 9,664,018 B2
(45) Date of Patent: May 30, 2017

(54) METHOD FOR FRACTURING SUBTERRANEAN ROCK

(71) Applicant: DRI FRAC TECHNOLOGIES LTD., Calgary (CA)

(72) Inventors: Angela Lee Vandeponseele, Calgary (CA); Steven Alan Mestemacher, Parkersburg, WV (US)

( * ) Notice: Subject to any disclaimer, the term of this patent is extended or adjusted under 35 U.S.C. 154(b) by 0 days.

(21) Appl. No.: 14/308,226

(22) Filed: Jun. 18, 2014

(65) Prior Publication Data

US 2014/0374108 A1 Dec. 25, 2014

Related U.S. Application Data

(60) Provisional application No. 61/836,762, filed on Jun. 19, 2013.

(51) Int. Cl.
*E21B 43/26* (2006.01)
*E21B 43/16* (2006.01)

(52) U.S. Cl.
CPC ..... *E21B 43/166* (2013.01); *E21B 43/26* (2013.01)

(58) Field of Classification Search
CPC ..... E21B 43/26; E21B 43/267; C09K 8/80
USPC ..... 166/308.2
See application file for complete search history.

(56) References Cited

U.S. PATENT DOCUMENTS 7,946,342 B1 * 5/2011 Robertson ..... C09K 8/58 166/263
2007/0256838 A1 * 11/2007 Baxter ..... C09K 8/64 166/308.3
2011/0240293 A1 * 10/2011 Lesko ..... C09K 8/665 166/280.1

FOREIGN PATENT DOCUMENTS

CA 2732804 A1 2/2011

OTHER PUBLICATIONS

"BOA SAGD" by Frac Advantage Simulation Tools Inc., published in http://www.fracadvantage.com/Tools/BOA%20SAGD%202013,pdf , undated.
"BOA SAGD" by Frac Advantage Simulation Tools Inc., //www.fracadvantage.com/.

* cited by examiner

*Primary Examiner* — Doug Hutton, Jr.
*Assistant Examiner* — Ashish Varma
(74) *Attorney, Agent, or Firm* — Sander R. Gelsing

(57) ABSTRACT

A method of hydraulically fracturing a subterranean formation is provided. The method comprises generating a primary fracture using a fracturing fluid. The method further comprises extending the primary fracture and/or creating micro fractures about the primary fracture by initiating a chemical reaction such as an exothermic reaction at about the primary fracture. In one embodiment, the fracturing fluid is used to convey one of the reactive components participating in the chemical reaction.

20 Claims, 3 Drawing Sheets

METHOD FOR FRACTURING SUBTERRANEAN ROCK

CROSS-REFERENCE TO RELATED APPLICATIONS

This application claims the benefits under 35 U.S.C. 119(e) of the U.S. Provisional Application Ser. No. 61/836,762, filed on Jun. 19, 2013, the subject matter of which is incorporated fully herein by reference.

FIELD

Embodiments described herein relate to a method for fracturing subterranean rock, more particularly for fracturing by using energy derived from a chemical reaction in combination with energy derived from fracturing fluids.

BACKGROUND

Unconventional hydrocarbons are hydrocarbons which come from subterranean rock formations, or reservoirs, that were previously deemed unproductive and uneconomic. Due to recent technological innovations and an abundant in-place supply, unconventional hydrocarbons have emerged as the potential energy resource of the future. Shale rock and/or tight rock are examples of an unconventional hydrocarbon source which is currently being exploited for the recovery of hydrocarbons as a reliable, affordable, energy source. The relatively large reserve of hydrocarbon resources trapped in shale rock formations has become more accessible over the past decade based on combining two established technologies: multistage hydraulic fracturing, and horizontal drilling. Historical processes to fracture rock include using dynamite, freezing, perforating explosives, pressurized water and other fluids, that can hydraulically fracture.

Hydraulic fracturing is a process used in most unconventional hydrocarbon wells. Large amounts of fracturing fluids including water, sand or proppants, and chemicals are pumped underground through a wellbore and delivered to a hydrocarbon-bearing subterranean rock formation to hydraulically break apart the rock for release of the hydrocarbons contained inside.

Typically, large hydraulic fracturing operations (also known as hydrofracking or "fracking") break subterranean rock formations by using pressurized fluids to create pathways for hydrocarbons to flow to the wellbore. Post-treatment, the hydrocarbons are conducted to surface through the wellbore. Hydraulic fracturing, therefore, "stimulates" the reservoir by simply breaking the rock to increase the conductivity, or flow pathways, of the reservoir to the wellbore.

Current hydraulic fracturing technologies use large quantities of pressurized fluids, typically water, in order to effectively break the rock and stimulate the reservoir. Proponents of hydraulic fracturing point to the economic benefits of the vast amounts of formerly inaccessible hydrocarbon energy which the process can extract. Opponents point to potential environmental impacts, including consumption of large volumes of fresh water, risk of breakthrough to, and contamination of, ground water, and the hydraulic fracturing chemicals causing contamination. The finite supply of fresh water should be treated as a valuable resource, such as to be made available for human consumption, and not necessarily as merely a low cost consumable for hydraulically fracturing rock formations.

For these reasons hydraulic fracturing has come under scrutiny internationally, with some countries suspending or banning it. Technical tools such as fracture simulation models, casing and cement designs and micro seismic data demonstrate that hydraulic fracturing, when executed according to proper design, is not the primary way that surface and ground waters become contaminated. The high volume of fresh water usage for unconventional formation fracturing has yet to be addressed properly, and is the focus of this technology.

In unconventional hydrocarbon recovery, horizontal wells are drilled and completed with multistage fracturing in order to effectively yield more stimulated subterranean rock. Each well utilizes hydraulic fracturing of about 10-40 multistage, spaced completions along the wellbore, each stage requiring water volumes of about 50 $m^3$ to 5000 $m^3$ of water. Overall, the multistage technology works well. For water conservation purposes, water recycling technology is being investigated, but is certainly not in widespread use. Applicant understands that an estimated 20% of the water pumped down for hydraulic fracturing is being recovered yet there can be restrictions, cost and complications in the application and reuse thereof.

The unconventional fracturing fluid typically comprises a mixture or slurry of water, proppants, chemical additives, gels, foams, and/or compressed gases. Typically, the fracturing fluid is 98-99.5% water with the chemicals accounting to 2 to 0.5%. The sand proppants are most often quartz with a specific gravity of 2.65 g/cc. Fresh water is overwhelmingly the largest component of hydraulic fracturing in unconventional hydrocarbon reservoirs.

A hydraulic fracturing operation for a single unconventional shale well can consume an amount of water equivalent to supply a population of 4,000 people for a day. In addition to the large volumes consumed, large amounts of energy are required to transport and prepare the water. It is becoming more apparent that the cost of water in today's usage has not caught up to the value of water in tomorrow's world. It is arguable that the current hydraulic fracturing process is not environmentally sustainable long term.

A long standing problem for mankind has been the need for a constant supply of fresh water. Fresh water to sustain human, animal and plant life comprises approximately 1-3% of the water on earth, including rain water, rivers and streams, and ground water. The prolonged use of water volumes for hydraulic fracturing can impact vegetation, animal, and human life. The technology being implemented today to obtain the valuable unconventional hydrocarbon resource adds additional stress to the environment in a negative way, impacting everyday life.

Unconventional hydrocarbons are emerging as a significant economic energy resource for the future, however further production techniques require advances in technology to harvest the abundant supply. It is incumbent on the industry to find an alternative process that will break rock, will honor the water resources, will not harm the environment, and will be economically executable.

Accordingly, a need remains for a fracturing process method in order to overcome the above-noted shortcomings.

SUMMARY

Embodiments described herein describe a methodology and process for breaking hydrocarbon bearing rock formations using reduced quantities of fresh water, and using existing fracturing equipment.

Embodiments described herein relate to a method for fracturing subterranean rock using a chemical reaction which enhances a primary fracture developed or created in the formation. As used herein "enhancing a primary fracture" means enlarging the primary fracture and this includes extension or propagation of the primary fracture or creation of micro fractures about the primary fracture. The primary fracture is initiated or created using water based or oil based fracturing fluids.

Accordingly in one broad aspect a method of hydraulically fracturing a subterranean formation penetrated by a wellbore is provided. The method comprises injecting a fracturing fluid through the wellbore and against the formation at a rate and pressure sufficient to generate at least a primary fracture into the formation at a fracture zone. The method further comprises deploying a first and a second reactive component, which are isolated from each other, into the wellbore. Isolation between the first and second reactive components is maintained until the first and second reactive components reach the fracture zone. The method further comprises generating the primary fracture. Finally, the method comprises extending the primary fracture and/or creating micro fractures about the primary fracture by initiating a chemical reaction at about the primary fracture by enabling contact between the first and second reactive components at the fracture zone.

In one embodiment, the chemical reaction is an exothermic chemical reaction. In one embodiment, the chemical reaction produces a gas. In another embodiment, the chemical reaction is an explosive reaction. In yet another embodiment, the chemical reaction is an endothermic reaction.

In one embodiment, initiating of the chemical reaction occurs simultaneously with the generation of the primary fracture. In another embodiment, initiating of the reaction occurs after the generation of the primary fracture.

In one embodiment, the first and second reactive components are disposed in a non-reactive carrier fluid. In one embodiment, the non-reactive carrier fluid for the first reactive component is the fracturing fluid and the first reactive component is injected with the fracturing fluid through the wellbore.

In one embodiment, the second reactive component is isolated from the first reactive component by encapsulating the second reactive component in an encapsulating jacket which disintegrates under predetermined wellbore conditions to initiate the chemical reaction at the fracture zone.

In one embodiment, the second reactive component is injected simultaneously with the first reactive component into the wellbore. In another embodiment, the second reactive component is injected into the wellbore after the first reactive component is injected into the wellbore.

In one embodiment, the second reactive component is isolated from the first reactive component by deploying the second reactive component to the fracture zone via a conveyance string in the wellbore, and the first reactive component is deployed to the fracture zone via an annulus formed between the conveyance string and the wellbore.

In one embodiment, one of the first and second reactive components is ammonia or an ammonia containing compound and the other of the first and second reactive components is an oxidizing agent.

In one embodiment, the ammonia containing compound is ammonium hydroxide.

In one embodiment, the oxidizing agent is a halogen containing compound wherein the halogen is selected from the group consisting of chlorine, bromine, fluorine, iodine, their respective salts and mixtures. In another embodiment, the oxidizing agent is a chlorine containing compound.

In one embodiment, the first and second reactive components are pumped downhole through a conveyance string disposed in the wellbore. In another embodiment, one of the first and second reactive components is pumped downhole through a conveyance string disposed in the wellbore and the other of the first and second reactive components is pumped downhole through an annulus formed between the conveyance string and the wellbore.

In one embodiment, one of the first and second reactive components or both of the first and second reactive components are in gaseous form. In another embodiment, one of the first and second reactive components or both of the first and second reactive components are in solid form.

In one embodiment, the first reactive component is an ammonium containing compound and the second reactive component is a chlorine containing compound and reaction between the first and second reactive components produces at least chlorine gas which is recycled to produce hydrogen chloride.

DETAILED DESCRIPTION

Figure 1:
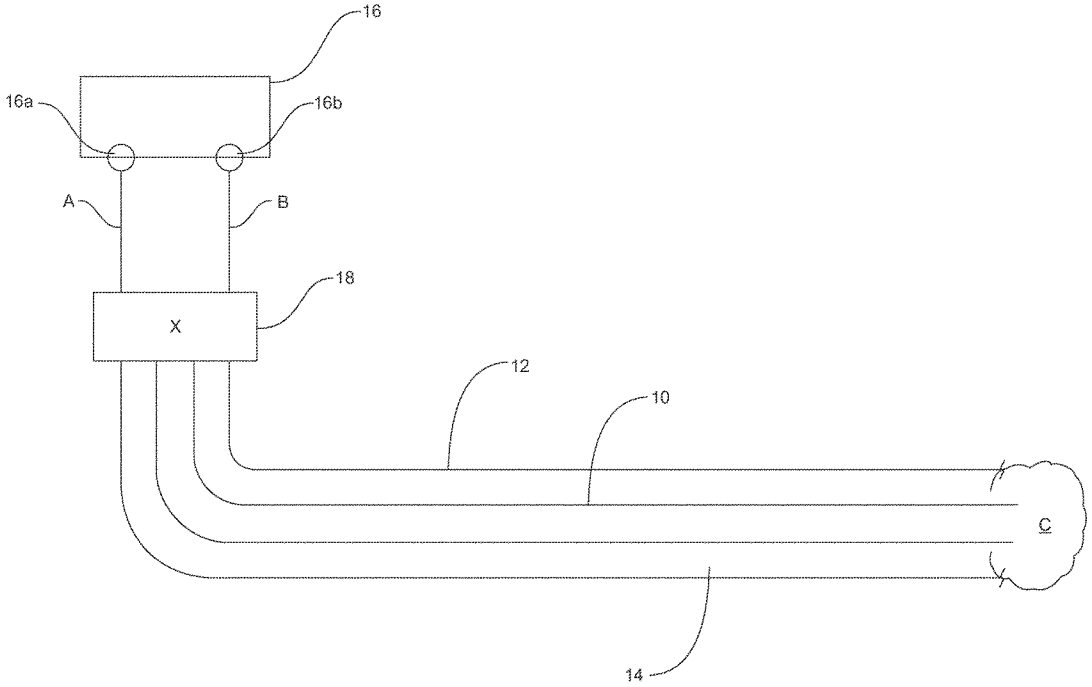
FIG. 1 is a schematic of a horizontal wellbore completed in a hydrocarbon formation, the wellbore and conveyance string completion allowing fluid isolation between the conveyance string and the wellbore annulus until reaching a predetermined mixing point for providing fracturing impetus.

With reference to the figures, a method for fracturing subterranean rock is disclosed herein. Fracturing subterranean rock simply means to break the rock below the surface. The same rock at surface could be broken with a hammer. However, in subterranean fracturing in wellbores the rock may be a few kilometers below the surface, and may therefore be under significant confining pressure. To fracture this rock, sufficient energy must be applied to stress the rock to failure, thereby generating fractures in the formation. Hydraulic fracturing applies pressure above that of the reservoir pressures. Hydraulic fracturing can currently be executed over a large range of pressures.

In existing hydraulic fracturing processes, fracturing energy is provided by the pressurized fracturing fluid. The volume of fracturing fluid pumped downhole, and the applied pressure, are related to the desired fracture penetration or volume. In the process described herein, fracturing energy is derived from two sources, hydraulic fracturing using pressurized fracturing fluid and additional expansion of the fractures created, or the generation of new fractures, using a chemical reaction. Thus, by using the methods described herein, the same fracture penetration as is obtained using conventional fracturing may be achieved using reduced amounts of fresh water.

In one embodiment, the fracturing process described herein is a single step process where development of a primary fracture and enhancement of the primary fracture occur simultaneously. In other words, fracturing energy from two different sources, pressurized fracturing fluid and the chemical reaction are provided at the same time.

In another embodiment, the fracturing process described herein is a two step process. In other words, fracturing energy is provided in two steps. In the first step a primary fracture is created or initiated by hydraulic fracturing, using fracturing fluids such as water or oil, and combinations of water and oil. The second step comprises propagating or extending the primary fracture by initiating a chemical reaction about the primary fracture.

The chemical reaction may be exothermic or endothermic. In one embodiment, the chemical reaction is an exothermic reaction. An "exothermic chemical reaction" as used herein means a reaction that generates heat. In some embodiments this heat is sufficient to lead to volumetric expansion, thereby creating mechanical stresses to aid in the enhancement of the primary fracture. In some embodiments the chemical reaction also generates a gaseous product. In some embodiments the chemical reaction is an explosive reaction.

In one embodiment, the chemical reaction is initiated by enabling contact between two reactive components, a first reactive component and a second reactive component, which are capable of reacting with each other via an exothermic reaction that may produce gas and/or that may be an explosive reaction.

In other embodiments, the process comprises enabling contact between two reactive components to produce a reaction product which, under appropriate conditions, leads to the chemical reaction. Non-limiting examples of downhole conditions that may trigger this chemical reaction include changes in temperature, changes in pressure, contact with mud or natural gas.

In one embodiment, the chemical reaction is initiated by enabling contact between two reactive components, a first reactive component and a second reactive component, which are capable of reacting with each other via an endothermic reaction that may produce at least gas and/or that may be an explosive reaction.

The first and second reactive components are selected depending on their ability to react with each other, or their ability to produce reaction products that have the potential under suitable wellbore conditions to generate heat, or gas, or explode. Other factors for selection of the first and second reactive components include cost, safety, availability, and handling. Accordingly, non-limiting examples of the first and second reactive components may include: ammonia or an ammonia-containing compound, and an oxidant, such as a halogen; acetone and hydrogen peroxide (to produce acetone peroxide which under selected conditions leads to an explosive reaction); and acetic acid and sodium bicarbonate.

Preferably, in the methods described herein the reactive components are conveyed downhole in liquid form. Accordingly, a solid or gaseous compound may be dissolved in a liquid such as water, oil, fracturing fluid or other fluid, before deployment downhole. The solutions are typically aqueous, with water being the major component in the solution, and wherein small amounts of other compounds may be present. In one embodiment, in order to form a liquid solution, preferably, the reactive components are mixed with the fracturing fluid, which is typically water. A reactive component may also be conveyed downhole in a solid or gaseous form, where it may react with a second component that is either in liquid form, or in solid or gaseous form.

In one embodiment, one or the first reactive component may be ammonia or ammonium hydroxide. Ammonia is produced using the Haber-Bosch process. The process reforms natural gas (methane) to produce the required hydrogen that is reacted with nitrogen extracted from air (by a cryogenic process) to form ammonia. Approximately 83% of ammonia is used as fertilizers either as its salts, solutions or anhydrously. Prior to injection downhole, ammonia is mixed with a suitable non-reactive liquid carrier such as water, to form ammonium hydroxide. In one embodiment, ammonia is mixed with the fracturing fluid.

In this embodiment the second reactive component may be a component which reacts with the ammonia or ammonium hydroxide in an exothermic reaction. In one embodiment, the second reactive component is an oxidant, such as a halogen, such as chlorine, fluorine, bromine or iodine. The second reactive component is also mixed with a suitable non-reactive liquid carrier prior to its injection downhole. In one embodiment, the halogen (in the form of a halogen-containing compound) is mixed with water prior to its injection downhole. In some embodiments the halogen-containing compound is a salt of a halogen, such as sodium chloride, sodium bromide, or sodium iodide. In some embodiments the second reactive component is a chlorine-containing compound such as sodium hypochlorite ("bleach").

In other embodiments, reaction between the first reactive component and second reactive component may produce reaction products such as nitrogen trichloride, nitrogen tribromide or nitrogen triiodide, which under selected conditions result in an explosive chemical reaction and therefore enhancement of the primary fracture.

As described above, the reactive components may be in liquid form prior to their injection downhole. The reactive components are kept isolated or separated from contact with one another before creation of the primary fracture at the fracture zone. One of the reactive components may be mixed with the fracturing fluid prior to its injection downhole for the first step of the method which is conventional hydraulic fracturing. In this case, the fracturing fluid serves two purposes, firstly in combination with pressure, providing the energy required for creation of the primary fracture at the fracture zone, and secondly being the carrier for one of the reactive components. The reactive component contained in the fracturing fluid may remain inactive during the creation of the primary fracture. In other words, the primary fracture may be created by the energy derived from the pressurized fracturing fluid injected downhole. The sole purpose of the reactive component contained in the fracturing fluid is to react with the other, or second reactive component.

The other, or second reactive component may be injected downhole simultaneously with the first reactive component, or it may be injected downhole after creation of the primary fracture. In the event that the second reactive component is injected downhole simultaneously with the fracturing fluid containing the first reactive component, the first and second reactive components may be kept isolated or separated from contact with one another until after the primary fracture is created or developed in the formation. If the second reactive component is injected after the primary fracture is created or developed in the formation, it is kept isolated or separated from contact with the first reactive component at least until the fracture zone, that is the zone of the primary fracture, is reached.

As explained above, the first and second reactive components are kept isolated or separated from contact with one another at least until the primary fracture is created, to avoid premature initiation of the chemical reaction aiding to the enhancement of the primary fracture. In one embodiment and with reference to FIG. 1, isolation is achieved by injecting one of the reactive components A downhole to the fracture zone C via the conveyance string 10 disposed in a wellbore 12 and the other reactive component B via the wellbore annulus 14. The two components will mix, or come into contact with one another downhole at the fracture zone C. Existing hydraulic fracturing equipment may be used to transport or inject the two reactive components into the wellbore through two different passages. As depicted in FIG. 1, blender 16 with two suction sides 16 and 16*b* and a wellhead isolation tool 18 may be used for pumping down the two reactive components through the conveyance string and the annulus separately. The components may be pumped downhole simultaneously or sequentially. In this embodiment, either of the reactive components may be encapsulated in a jacket, as described further below.

Figure 2:
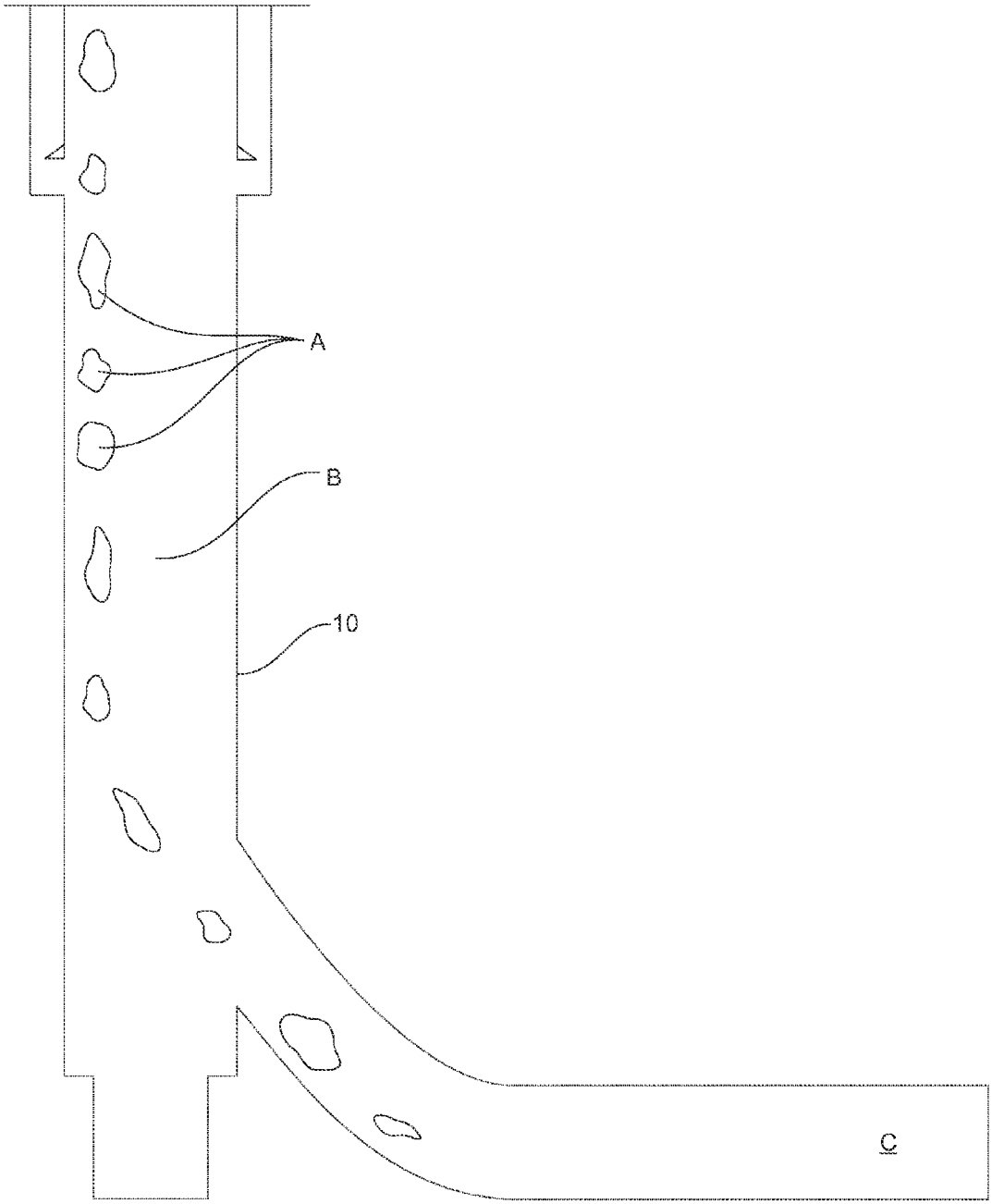
FIG. 2 is a schematic illustrating injection of at least two reactive components providing fracturing impetus through a conveyance string such as a tubing string or a casing.

In another embodiment and with reference to FIG. 2, isolation is achieved by disposing one of the two reactive components A in one or more encapsulating jackets which disintegrate or decompose under predetermined operating conditions such as temperature, pressure, pH, abrasion or combinations thereof. Reactive component A is injected downhole via conveyance string 10. The other reactive component B is also injected downhole via conveyance string 10.

Encapsulation prevents interaction between the two reactive components at least until the fracture zone C is reached, and allows simultaneous injection of the two reactive components through one wellbore passage. For example, the two reactive components may be injected downhole via the conveyance string 10 as shown in FIG. 2. Disintegration of the encapsulating barrier allows the two reactive components to contact one another and thereby activates or triggers the chemical reaction. Encapsulation may be achieved using a degrading envelope or coating in a similar process to conventional encapsulation methods known in the industry for fracturing fluid gel breakers for current guar, cross-linked fracturing fluids and encapsulated acid.

As explained above, fluid streams containing the first and second reactive components may be pumped downhole in concurrent streams through the same wellbore passage or through different wellbore passages using existing technologies and equipment. The fracturing fluid may be used as a medium for transporting one or both of the reactive components. While the fracturing fluid containing the first reactive component is pumped downhole, or after it is pumped downhole, the other reactive component is injected downhole through the same passage or different passages for initiation of the chemical reaction at the fracture zone.

The chemical reaction described herein can be effected by using easily and domestically sourced reactive components. Applicant has identified that the cheapest and most accessible reactive components for initiating an exothermic reaction may be ammonia and chlorine. When mixed, chlorine (in the form of a chlorine-containing solution) and ammonia in solution (i.e., ammonium hydroxide) contained in the fluid streams pumped downhole explode to produce a byproduct of chlorine gas. The reactive components are relatively abundant and are familiar to the public as Comet® Cleanser (liquid chlorine) and Windex® (household ammonia). The simplicity of this reaction minimizes water use and the analogy to familiar chemicals minimizes public concerns.

The following paragraphs describe a typical fracturing operation employing the process steps described herein. With reference to FIG. 1, and in one embodiment, the first and second reactive components are transported and stored at the well site in separate units (not shown) coupled to blender 16. In this case, the first reactive component ammonia is mixed with the fracturing fluid and is pumped downhole through the conveyance string 10. The second reactive component, a chlorine-containing compound mixed with a non-reactive carrier fluid, is disposed in an encapsulating jacket. After the zones of interest have been identified and the casing is perforated, fracturing fluid containing the first reactive component is injected into the wellbore through the conveyance string at a pressure greater than wellbore pressure for creating a primary fracture in the formation at a predetermined depth. During formation of the primary fracture, the first reactive component remains passive. Simultaneously, the encapsulated second reactive component containing chlorine is pumped down through the annulus 14. The encapsulated chlorine and the ammonia solution remain separated as they travel downhole until they reach the predetermined depth or location of the primary fracture. At about the primary fracture, the encapsulation disintegrates enabling the second reactive component containing chlorine, to mix and react with the first reactive component, ammonia solution, for enhancement of the primary fracture. An exothermic reaction between chlorine and ammonia solution results in chlorine gas ($Cl_2$ gas).

Chlorine gas is corrosive, poisonous, and heavier than air and must be handled with care. Chlorine gas may be treated according to treatments already existing for treatment of other oilfield emissions such as hydrogen sulfide gas ($H_2S$). Treatment of chlorine gas by passing it through a water bath yields hydrochloric acid (HCl) which is a useful, revenue generating fluid. HCl is highly useful in oilfield operations, chemical manufacturing and many other industries.

Figure 3:
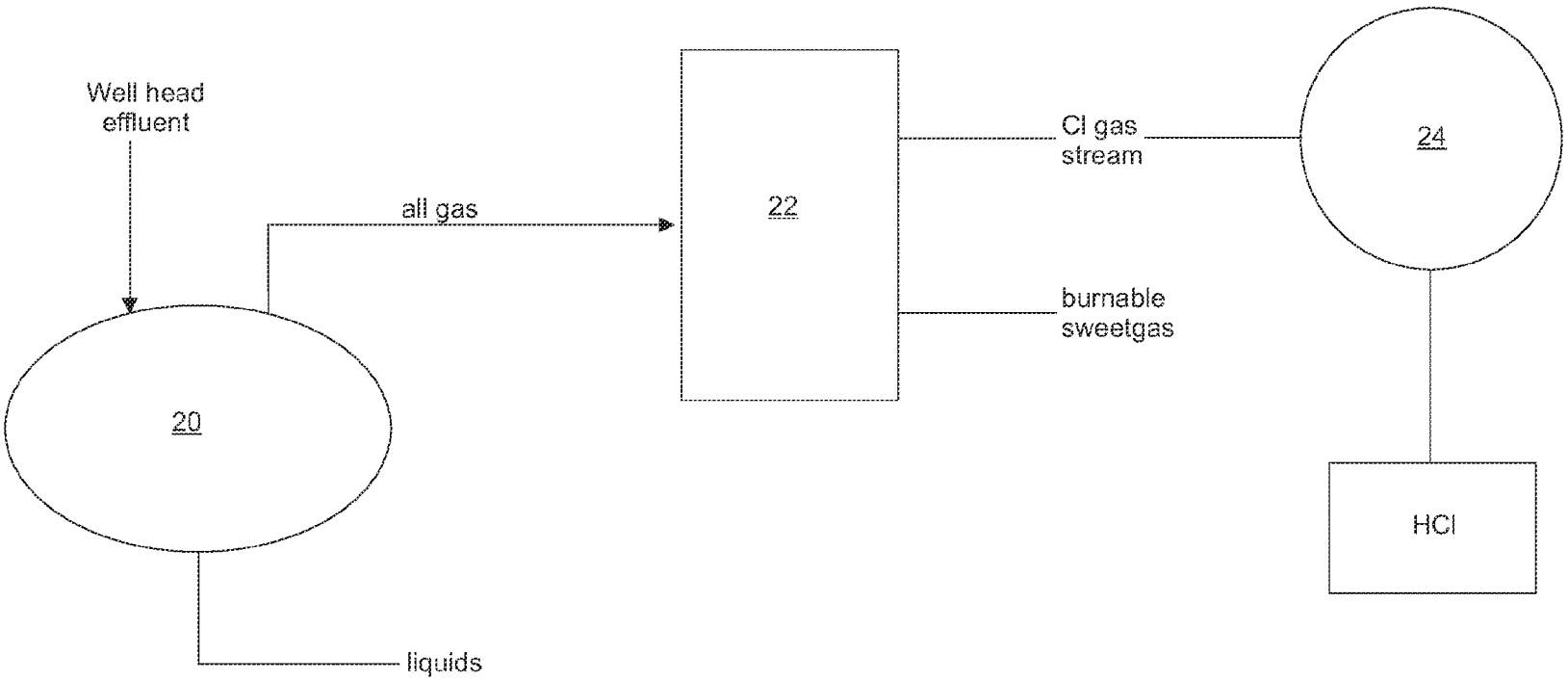
FIG. 3 is a schematic of a flow-back process for recovery of fracturing components after fracturing is complete.

FIG. 3 illustrates steps involved in treating $Cl_2$ produced during the fracturing operation described herein. After fracturing is completed, the fracture fluids, hydrocarbons, sour gases ($H_2S$, $Cl_2$) and residual sand or proppant are flowed back into a sealed, pressurized separator vessel 20. The gases are separated from the fluids and are sent down pipelines to the field plant for further treatment or disposal. The gases are received by a chlorine scrubber 22 which separates the chlorine gas from the other gases. The separated chlorine gas stream is run through a water bath 24 to generate HCl. Chlorine gas reacts with water as follows to produce HCl:

$$2Cl_2+2H_2O \rightarrow 4HCl+O_2$$

The method described herein conserves fresh water, effectively breaks reservoir rock, has a less negative impact on the environment, and is safely and economically executable. Another feature of the described process is that, as a result of the reduced water usage and nature of the replacement fluids, there is anticipated to be fewer objections from the public at large. A further advantage of the process described herein is that it is easily and rapidly deployed using a majority of existing fracturing systems/equipment. Although the example included herein describes conveying the two reactive components downhole in liquid form, in other embodiments the reactive components may be conveyed downhole in solid or gaseous form. For example, if one of the reactive components is gas, it may be injected downhole with the fracturing fluid. Isolation may be achieved by encapsulating the other reactive component. Isolation may also be achieved by conveying the two reactive components through different passages as shown in FIG. 1. If one of the reactive components is solid such as sodium bicarbonate it may be mixed with an appropriate fracturing fluid such as saline water before it is conveyed downhole. Isolation with the other reactive component may be achieved by methods described above. Alternatively a solid reactive component may be encapsulated as a solid, and injected downhole with the other reactive component being disposed in the fracturing liquid. Existing fracturing systems/equipment may be used for conveying the reactive components downhole in solid, gaseous or liquid form.

What is claimed is:

1. A method of hydraulically fracturing a subterranean formation penetrated by a wellbore, the method comprising:

injecting a fracturing fluid through the wellbore and against the formation at a rate and pressure sufficient to generate at least a primary fracture into the formation at a fracture zone;

deploying a first and a second reactive component, which are isolated from each other, into the wellbore and maintaining said isolation until the first and second reactive components reach the fracture zone;

generating the primary fracture;

extending the primary fracture and/or creating micro fractures about the primary fracture by initiating a chemical reaction simultaneously with the generation of the primary fracture by enabling contact between the first and second reactive components at the fracture zone; and wherein the chemical reaction is a chemical explosive reaction.

2. The method of claim 1, wherein the chemical reaction is an exothermic reaction.

3. The method of claim 1, wherein the chemical reaction produces a gas.

4. The method of claim 1, wherein the first and second reactive components are disposed in a non-reactive carrier fluid.

5. The method of claim 4, wherein the non-reactive carrier fluid for the first reactive component is the fracturing fluid.

6. The method of claim 5, wherein the first reactive component is injected with the fracturing fluid through the wellbore.

7. The method of claim 1, wherein the second reactive component is isolated from the first reactive component by encapsulating the second reactive component in an encapsulating jacket which disintegrates under predetermined wellbore conditions to initiate the chemical reaction at the fracture zone.

8. The method of claim 1, wherein the second reactive component is deployed simultaneously with the first reactive component into the wellbore.

9. The method of claim 1, wherein the second reactive component is deployed into the wellbore after the first reactive component is deployed into the wellbore.

10. The method of claim 1, wherein the first and second reactive components are isolated by deploying one of the first and second reactive components to the fracture zone via a conveyance string in the wellbore, and the other of the first and second reactive components to the fracture zone via an annulus formed between the conveyance string and the wellbore.

11. The method of claim 1, wherein one of the first and second reactive components is ammonia or an ammonia containing compound and the other of the first and second reactive components is an oxidizing agent.

12. The method of claim 11, wherein the ammonia containing compound is ammonium hydroxide.

13. The method of claim 11, wherein the oxidizing agent is a halogen containing compound wherein the halogen is selected from the group consisting of chlorine, bromine, fluorine, iodine, their respective salts and mixtures.

14. The method of claim 13, wherein the halogen is chlorine.

15. The method of claim 13, wherein the oxidizing agent is a chlorine containing compound.

16. The method of claim 1, wherein the first and second reactive components are pumped downhole through a conveyance string disposed in the wellbore.

17. The method of claim 1, wherein one of the first and second reactive components or both of the first and second reactive components are in gaseous form.

18. The method of claim 1, wherein one of the first and second reactive components or both of the first and second reactive components are in solid form.

19. The method of claim 1, wherein the first reactive component is an ammonium containing compound and the second reactive component is a chlorine containing compound and wherein reaction between the first and second reactive components produces at least chlorine gas and the chlorine gas is recycled to produce hydrogen chloride.

20. The method of claim 1, wherein the chemical reaction produces at least one of acetone peroxide, nitrogen trichloride, nitrogen tribromide and nitrogen triiodide as a reaction product.

* * * * *